United States Patent [19]

Ishida

[11] 4,030,294

[45] June 21, 1977

[54] COMPRESSED AIR GENERATING DEVICE FOR FORKLIFT TRUCKS

[75] Inventor: Teisuke Ishida, Mito, Japan

[73] Assignee: Japan Patent Center Inc., Tokyo, Japan

[22] Filed: Mar. 24, 1976

[21] Appl. No.: 669,916

[52] U.S. Cl. ..... 60/407; 60/477; 60/478

[51] Int. Cl.[2] ..... F15B 11/06

[58] Field of Search ..... 60/407, 455, 477, 478, 60/327

[56] References Cited

UNITED STATES PATENTS

| | | | |
|---|---|---|---|
| 2,548,439 | 4/1951 | Moffett | 60/407 X |
| 3,058,310 | 10/1962 | Panissidi | 60/327 X |
| 3,130,548 | 4/1964 | Hunt | 60/478 UX |

*Primary Examiner*—Edgar W. Geoghegan
*Attorney, Agent, or Firm*—Fleit & Jacobson

[57] ABSTRACT

A compressed air generating device for forklift trucks in which a main pipeline connected to the end of the lift cylinder air chamber branches into a high-pressure air pipe and a return pipe, selectively communicating with the main pipeline through a switching valve means. With the main pipeline switched to communication with the main pipeline high-pressure air pipe, during the descending phase of the piston, air is sucked through an air suction pipe attached to the main pipeline into the lift cylinder air chamber, and during the rising phase of the piston, the air in the air chamber is compressed and is sent into an air tank as compressed air.

1 Claim, 2 Drawing Figures

COMPRESSED AIR GENERATING DEVICE FOR FORKLIFT TRUCKS

BACKGROUND OF THE INVENTION

Generally forklift trucks (hereinafter referred to simply as "forklift") are statutorily required to have all their tires checked for air pressure prior to the day's operation and have the tires filled with air to the specified level. To have the tires filled with air every morning, in most work shops, the forklifts must be brought to the filling station every morning. If tires are deflated excessively, they have to be removed from the forklift, brought to the filling station, filled with air, brought back to the forklift, and remounted on the forklift. These processes are complicated and time-consuming. The tire filling processes may be simplified when an air compressor is prepared, and compressed air produced by this compressor is led to the packing sites of the forklifts by pipes and hoses for ready use for tire filling. However, since this method requires a large sum of capital to be invested, only large scale forklift workshops where many forklifts are employed can adopt it.

If each forklift is provided with a compressed air producing device and storing device, tire air control can be most conveniently maintained. At present, some forklifts are equipped with an air compressor driven from the engine by belts, but since such an air compressor is quite expensive, comparatively few workshops can afford it.

SUMMARY OF THE INVENTION

The object of the present invention is to provide a device which enables each forklift to produce high-pressure air, to store it, and to utilize it as required. When a device based on the present invention is employed in a 10-ton-truck, the advantages of the present invention are displayed well. Furthermore, when a device based on the present invention is composed in the form of an attachment unit that can be conveniently attached to existing forklifts or the like, the utilization factor of the device is still increased.

Since the present invention relates to a device which obtains a high-pressure air by utilizing an un-utilized portion of the standard type forklift widely employed, before starting to describe the present invention, the portions of the conventional standard forklift having relation to the present invention will be described first.

BRIEF DESCRIPTION OF DRAWINGS

Figure 1:
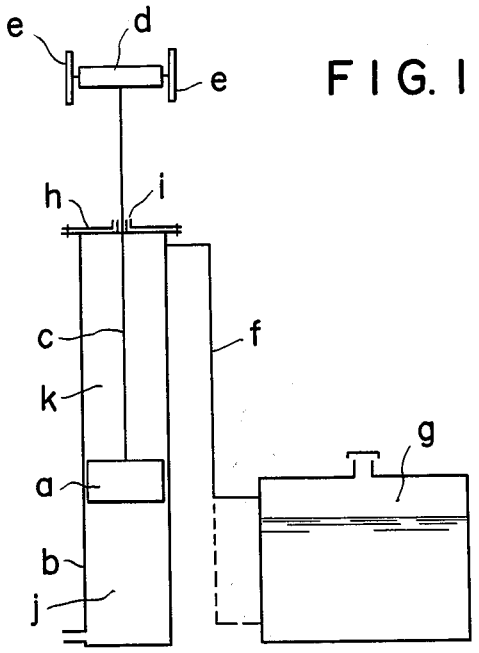
FIG. 1 is an explanatory diagram of the principal portions of a conventional standard forklift truck showing the fork lifting operation principle.

In FIG. 1, the fork lifting equipment of the conventional standard forklift is shown. When the piston (a) rises in the lift cylinder (b), the piston rod (c) is pushed up together with the piston head (d) positioned at the top of the piston rod. The piston head (d) is connected to the mast slidably guided by the frame. When the piston head (d) rises, the sprockets (e) attached thereto also rise, so that the chains passing over the sprockets (e) are pulled and the fork connected to the ends of the chains is lifted. When the piston (a) falls, all the members described above move in the reverse directions and the fork is lowered. While the piston (a) is pushed up by hydraulic pressure working on its lower surface in its rising phase, it is lowered by its own weight in its falling phase. When the piston (a) rises, it scraps lubrication oil and other oil adhering to the bore of the lift cylinder (b), and sends the scraped and lifted oil through the return pipe (f) having an opening at the top of the lift cylinder (f) to the oil tank (g). The cylinder cover (h) is provided with a dust scraping ring, an oil seal ring, and a bushing (i) where the piston rod (c) penetrates. As the lift cylinder (b) is filled with oil only in the portion (j) below the piston (a), and the portion above the piston (a) is filled with air, this portion forms a so-called air chamber (k). Therefore, the air in the air chamber (k) is forced out as the piston moves upward, and air is sucked into the air chamber (k) as the piston moves downward. The flow of air into and out of the air chamber is made through the return pipe (f) and the oil tank (g). Because the lift cylinder (b) is supplied with pressure oil only in the lower portion (lower cylinder portion j) to actuate the piston (a), the air chamber (k) has no positive function in moving the fork up and down, so that it is an un-utilized part.

Figure 2:
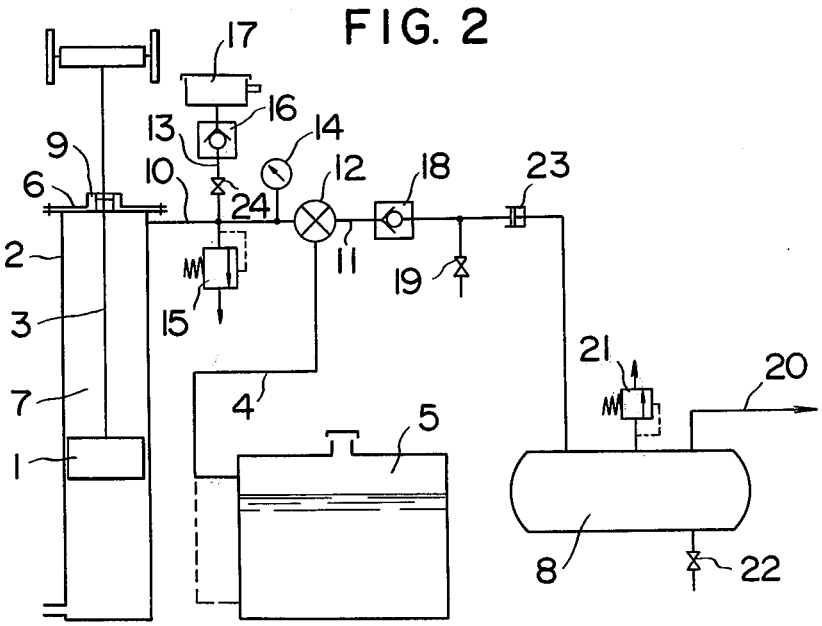
FIG. 2 is an explanatory diagram showing the principal portions of an embodiment of the present invention.

In FIG. 2, an embodiment of the present invention is shown to serve as a reference for the description of the present invention given below.

In the present invention, instead of discharging air in the air chamber 7 during the rising phase of the piston 1, the lift cylinder 2 is so connected with an air tank 8 that during the rising phase of the piston 1, the air in the air chamber 7 is compressed to a high pressure, sent to and stored in the air tank 8.

Because a forklift is required to perform its normal operation during its operating time, all the components shown in FIG. 1 must be constructed in the same way also in the embodiment shown in FIG. 2.

However, since the dust scraping ring and the oil seal ring employed where the piston rod 3 penetrates the cylinder cover 6 must be air-tight to prevent the high-pressure air in the air chamber 7 from leaking through them, they are replaced by a gland packing 9. At the top portion of the air chamber 7, the main pipeline 10 is connected, and this main pipeline 10 branches into two lines, one line being the high-pressure air line 11, and the other line being the return line 4. There is the switching cock 12 at the branching point by means of which the main pipeline 10 can selectively be communicated with only the high-pressure line 11, or only with the return line 4.

To the main pipeline 10, the air suction pipe 13, the air pressure gauge 14, and the relief valve 15 are connected, and to the airsuction pipe 13, the suction check valve 16 and the air filter 17 are connected. The high-pressure air line 11 is connected to the air tank 8 over the force out check valve 18, and at an appropriate point along the line to the air tank, the drain cock 19 is connected. The air tank 8 is provided with the high-pressure air outlet pipe 20, the safety valve 21, and the tank drain cock 22. Although in principle, high-pressure air is taken out for use through the outlet pipe 20, from the air tank 8, the situation may arise wherein the tank 8 has insufficient air pressure to perform the desired task. Therefore, if a quick joint 23 is provided along the high-pressure line 11, when a very limited amount of high-pressure air is needed, for example, to clean an engine air filter or to increase the inflation of a tire, an air hose may be connected directly to the system at the quick joint 23, thereby providing a convenient access to limited amounts of high-pressure air.

When the forklift performs its intended lifting function, the compression chamber device must necessarily be operated; however, if there is high-pressure air remaining in the air chamber 7, it will apply an opposing force to the top surface of the piston 1. Although this opposing force will not halt the piston 1 from rising, it will wastefully consume energy. Accordingly, the switching cock 12 is so positioned that the main pipeline 10 is connected to the return pipe 4 and disconnected from the high-pressure line 11. Then, during the time the piston 1 descends, air flows into the air chamber 7 mainly through the air suction pipe 13, and during the time the piston rises, the air in the air chamber 7 flows out through the return pipe 4 into the oil tank 5.

In some forklifts, the return pipe 4 is connected to the oil tank 5 at some point below the oil level, as shown in FIG. 2 by dotted lines. In these forklifts, during the time the piston 1 descends, oil is sucked into the air chamber 7 from the oil tank 5. With this type of forklift, therefore, when the operation is to be switched from the forklift's intended lifting function to that of providing compressed air, it is necessary to remove any oil which had been previously sucked into the air chamber 7. To accomplish this first the piston 1 is lifted to the top position to force oil in the air chamber 7 into the oil tank 5, and then, the switching cock 12 is turned to connect the main pipeline 10 with the high-pressure air line 11. Furthermore, during the time the forklift is operated to perform its originally intended lifting function the entry of air into the air chamber 7 is prevented by the manipulation of an air suction pipe cock 24 connected at an appropriate position along the air suction pipe 13.

Air filling pressure of tires is normally 7 atm. The device according to the present invention is capable of producing high-pressure air at around 10 to 15 atm, and storing it in the air tank 8. Because with this device, high-pressure air is not produced in large amounts continuously, no special consideration is necessary to dissipate the heat developing in the compressing process of air.

a The switching cock 12 is located conveniently for manipulation by the forklift driver, and a cock on the high-pressure air outlet pipe 20 and the quick joint 23 are located where handling is convenient in using high-pressure air. The air pressure gauge 14, relief valve 15, suction check valve 16, air filter 17, and force out check valve 18 are all grouped conveniently in a small space so as not to adversely influence the driver's view and his driving activities.

Because only a small amount of high-pressure air is required to replenish the tires that lose air from time to time through leakage, it will be sufficient that the forklift is operated as an air compressor only during its idle time when produced high-pressure air is stored in the air tank. Because in the present invention, no special air compressor is required, but the air chamber 7 of the lift cylinder which is not normally utilized is utilized to obtain high-pressure air, the cost of modifying a conventional forklift into the form of the present invention is low.

As described earlier, to be able to produce high-pressure air in a forklift is very advantageous in the air pressure control for tires, so that the present invention which enables high-pressure air to be produced by the utilization of idle time and un-utilized parts of a mechanism without requiring a large number of additional expensive parts, is vary valuable.

Furthermore, the high-pressure air obtained in the device according to the present invention is utilizable not only for filling tires, but also for air-blow cleaning of air-related equipments, carburators and other engine parts, for kerosene air spray cleaning of parts, and for driving impact wrenches and other pneumatic tools.

What is claimed is:

1. In a compressed air generating device for forklift trucks, the improvement in which a main pipeline connected to an end of a lift cylinder air chamber brances into a high-pressure air pipe and a return pipe, selectively communicating with the main pipeline through a switching valve means, and when the main pipeline switches to communication with the high-pressure air pipe, during a descending phase of a piston in the lift cylinder, air is sucked through an air suction pipe attached to the main pipeline into the lift cylinder air chamber, and during a rising phase of the piston, the air in the air chamber is compressed and is sent into an air tank as compressed air.

* * * * *